United States Patent [19]

Meyer

[11] Patent Number: 4,842,030

[45] Date of Patent: Jun. 27, 1989

[54] LOG SPLITTER IMPROVEMENTS

[76] Inventor: John P. Meyer, 5104 North Montana, Helena, Mont. 59601

[21] Appl. No.: 137,973

[22] Filed: Dec. 28, 1987

[51] Int. Cl.[4] ..... B27L 7/00

[52] U.S. Cl. ..... 144/193 A; 144/366; 414/546

[58] Field of Search ..... 144/3 K, 193 R, 193 D, 144/193 E, 366; 254/104; 414/546

[56] References Cited

U.S. PATENT DOCUMENTS

| | | | |
|---|---|---|---|
| 899,328 | 9/1908 | Saecker | 144/193 R |
| 3,862,651 | 1/1975 | Heikkinen | 144/193 A |
| 4,103,724 | 8/1978 | Braid | 144/193 A |
| 4,240,476 | 12/1980 | Rattray | 144/193 R |
| 4,373,564 | 2/1983 | Heikkinen | 144/366 |
| 4,431,362 | 2/1984 | Wech, Jr. et al. | 144/193 A |
| 4,544,008 | 10/1985 | Reini | 144/193 A |
| 4,589,457 | 5/1986 | Schmidt et al. | 144/193 E |

*Primary Examiner*—W. Donald Bray
*Attorney, Agent, or Firm*—William D. West

[57] ABSTRACT

Improvements in log splitting devices including an improved log-lifting table having multiple attachment points and greater upward radial movement. A multiple-faceted splitting wedge is also disclosed having a cutting angle of less than 90 degrees and a splitting angle of greater than 90 degrees.

4 Claims, 2 Drawing Sheets

LOG SPLITTER IMPROVEMENTS

BACKGROUND OF THE INVENTION

1. Field of the Invention

This invention relates to log splitter improvements, and more particularly to such a log splitter having a hydraulic-powered two-part telescoping lifting table and an improved splitting wedge.

2. Discussion of the Technical Problems

Log splitting machines having power rams forcing logs against stationery wedges have been known in the prior art. Additionally, log splitting machines are well developed in which logs are automatically fed to the log splitters. Such log splitter feeding devices generally use conveyors and winches.

U.S. Pat. No. 4,544,008 issued Oct. 1, 1985 to Reini discloses a log lifter for a log splitter in which a frame is provided to lift logs to a position in which the log can be rolled to the splitting station. It has been found that the lifting frame of the Reini log splitter as disclosed in U.S. Pat. No. 4,554,008, while certainly an improvement over winches and conveyors, is restricted in the amount of upward travel that the lifting frame and any logs placed thereupon may be lifted. Additionally, log splitters of the Reini type utilize conventional splitting wedges which tend to cut the log when the hydraulic ram pushes the log against the splitter and do not utilize the two-fold splitting action of a multiple-faced splitter.

Thus a need exists for inexpensive and efficient improvements to a log splitter in which a two-piece lifting table having a hydraulically actuated pivotally mounted ram is provided to allow the lifting table to be raised beyond a strictly horizontal position and in which the wedge utilizes a multiple face with an increasing angle to effectively split the log rather than to slice or cut the log.

Such improvements in a log splitter should be uncomplicated in design, easily repaired, not subject to damage by proper use, and simple to manufacture. The instant invention is directed to all these needs as well as to others as explained in the following summary.

SUMMARY OF THE INVENTION

In accordance with the present invention, it is a feature of the invention to provide improvements in log-lifting log splitters including a two-piece lifting table attached by use of a hydraulic cylinder to allow a wide range of travel, a flow-control valve on the lifting cylinder to regulate the speed of the lift of the table, and a splitting wedge which encompasses two angular wedge faces which combine to split rather than merely cut the log.

These and other features are attained according to the instant invention by providing an improved log-lifting feeding log splitter having a two-piece telescopically attached lifting table which is pivotally connected to the frame of the log splitter and having a hydraulic power cylinder operably connected between the frame and the innermost section of the lifting table and providing multiple points of attachment whereby the lifting table can be positioned in an upright mode for convenient travel and convenient shifting of the center of gravity to provide for more efficient trailer transport. Also in accordance with the improvements on a log splitter of this invention is provided a splitting wedge attached to the frame of the splitter in which the initial face of the wedge has a wedge angle less than 90 degrees and a second log-dividing angle greater than 90 degrees. Such a wedge utilizes the force of the power ram to tear the log apart and split it rather than to merely slice or cut the log. The log splitter thus can separate both wet and dry wood and utilize a short throw of the hydraulic cylinder.

BRIEF DESCRIPTION OF THE DRAWINGS

The advantages of this invention will become apparent upon consideration of the following detailed disclosure of the invention, especially when taken in conjunction with the accompanying drawings, wherein.

DESCRIPTION OF THE PREFERRED EMBODIMENT

Figure 1:
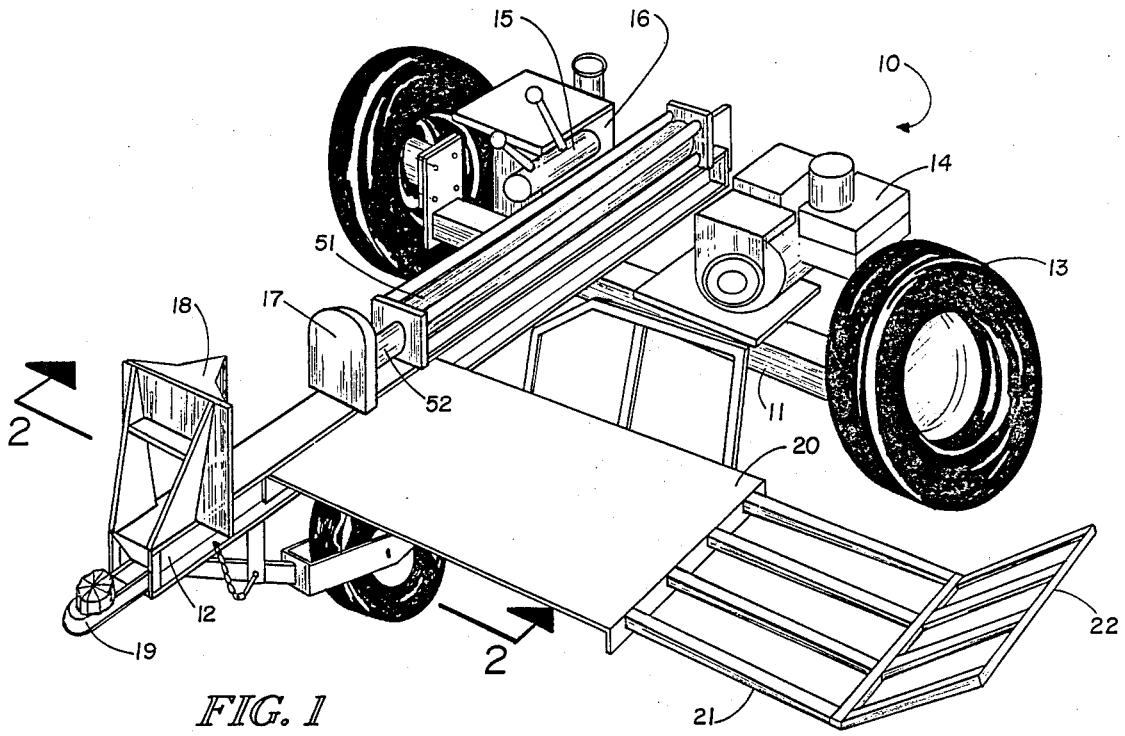
FIG. 1 is a perspective view of the log splitter having the improved table and splitting wedge attached thereto in accordance with the present invention.

The improvement on log splitters of the instant invention is depicted generally in FIG. 1. Referring to FIG. 1, it can be seen that log splitter 10 is provided with a frame 11 having an elongated splitting portion 12, a splitting wedge 18, a power cylinder 51 forcing a ram 17 toward wedge 18. Splitter 10 is further provided with a two-part lifting table 20 and 21.

Figure 2:
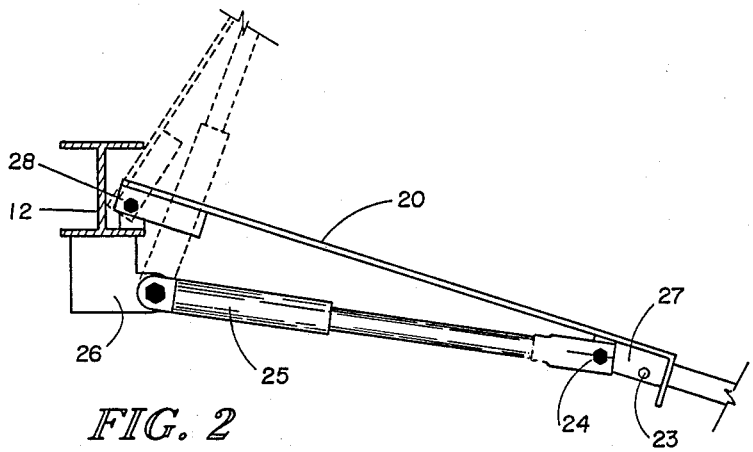
FIG. 2 is a partial cross sectional view taken across the longitudinal I-beam of the frame as depicted in FIG. 1 showing the attachment of the second hydraulic cylinder.

Referring now to FIG. 2 where it can be seen that lifting table 20 is further provided with a lifting power cylinder 25 having pivotal attachment bracket 26 and table attachments 23 and 24 to provide multiple attachment points for both use and transportation.

Figure 3:
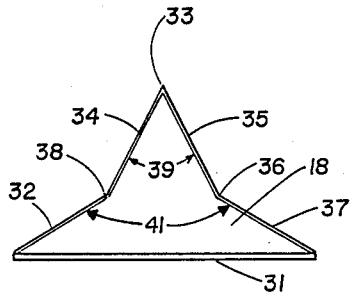
FIG. 3 is a top end view of the splitting wedge in accordance with the present invention.

The improvement in log splitting devices also provides an improved splitting wedge 18 as depicted in FIGS. 1 and 3. Splitting wedge 18 is further provided with wedge point 33, cutting faces 34 and 35 having cutting face angles 39 which intersect with splitting angle 41 at intersection points 38 and 36. Splitting angle 41 is also provided with shoulder faces 37 and 32. Cutting wedge 18 is also provided with backing plate 31 to provide structural rigidity and a bracket for mounting wedge 18 upon frame 12.

Figure 4:
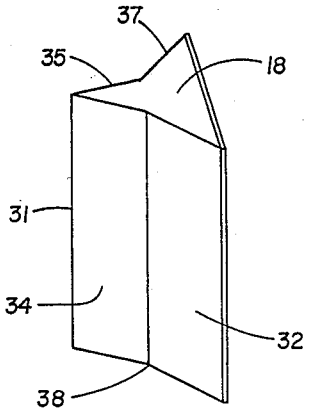
FIG. 4 is a perspective view of the splitting wedge in accordance with the present invention.

With reference now to FIG. 4, it can be seen that splitting wedge 18 defines a plurality of faces so that cutting faces 34 and 35 are arranged at an acute angle with respect to each other, whereas splitting faces 37 and 32 are at an oblique angle.

Figure 5:
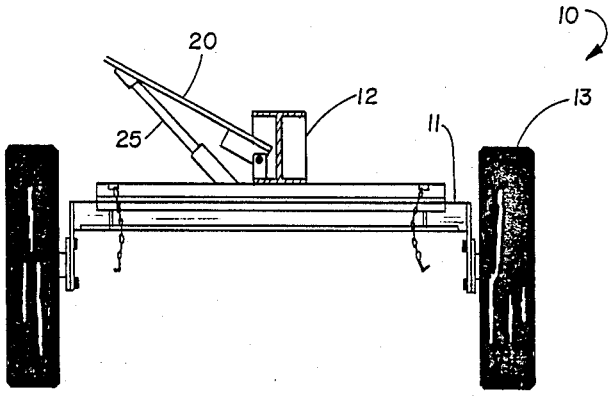
FIG. 5 is an end view of the log splitting apparatus in a raised position in accordance with the present invention.
Figure 6:
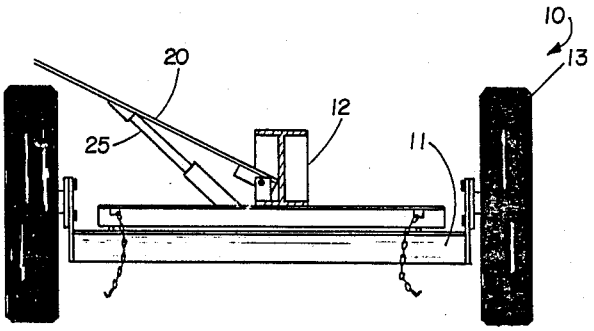
FIG. 6 is an end view of the log splitting apparatus in a lowered or towing position in accordance with the present invention.

With reference now to FIGS. 5 and 6 it can be seen that the log splitter is provided with a movable axle so that in FIG. 5 it can be seen that the log splitter is in the up or working position and in FIG. 6 it is in the lowered position so that center of gravity is lower to provide a safe, efficient towing operation. When in a position for towing as depicted in FIG. 6 table 20 should be in the raised position and ram 25 would be in an extended position with the point of attachment 24 as the attachment bolt 24 as depicted in FIG. 2 moved to position 23 to provide a greater throw and even increased raising to the verticle position for transport. Additionally, when in the transport position telescopic table attachment 22 can be removed.

Although any method of raising and lowering the log splitter can be utilized in its preferred embodiment the vehicle axle as disclosed and claimed in Applicant's co-pending application is preferred.

Figure 7:
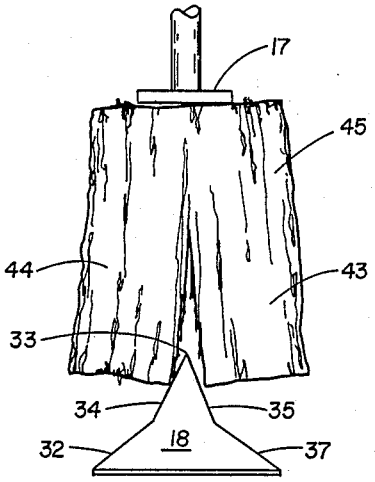
FIG. 7 is a top end view of the splitting wedge in the initial stage of splitting a log.
Figure 8:
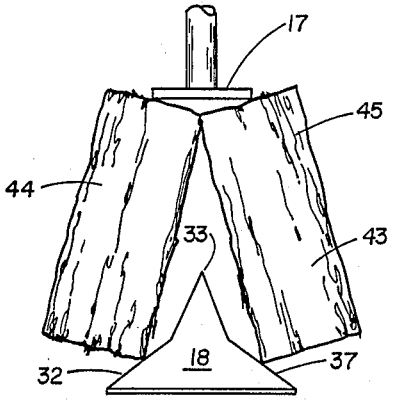
FIG. 8 is a top end view of the splitting wedge in a later stage of splitting a log.

With reference to FIG. 7, it can be seen that when a piece of wood 45 is forced by ram 17 against cutting wedge 18, the wood 45 initially splits by use of cutting faces 34 and 35 and cutting point 33 to open up a fissure in log 45. When the ram 17 is moved closer to wedge 18 as depicted in FIG. 8 such that half pieces 43 and 44 of log 45 rest upon splitting faces 37 and 32, which have the greater oblique angle as depicted in FIG. 3, thereupon the further movement of ram 17 causes the fissure in wood 45 to split open along natural faults within the wood to open up the wood in a well defined splitting pattern, thus enabling the operator to open and split wet or dry wood with only a short throw of the hydraulic cylinder.

Although specific applications, materials, components, connections, sequences of events, and methods have been stated in the above description of the preferred embodiment of the invention, other suitable materials, other applications, components and process steps as listed herein may be used with satisfactory results and varying degrees of quality. In addition, it will be understood that various other changes in details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention as hereinafter claimed.

I claim:

1. An improvement in a log-splitting machine of the type having an elongated frame, a log-splitting station defined by a wedge mounted to the frame, a log-splitting cylinder mounted to the frame and having a reciprocating piston adapted to push a log against the wedge, a log lifter for feeding logs to the splitting station of the type having a frame means extending laterally from and pivotally connected at a first end to the log-splitting frame for rotation about an axis between a first ground-contacting position and a second elevated position, the improvement comprising:

a wedge having at least two pairs of working faces defining a cutting angle and a splitting angle and wherein the cutting angle has an angle from about 45 to 60 degrees and said splitting edge has an angle of from about 100 to 140 degrees; and wherein said log lifter is a two-part pivotally attached log-lifting table operably connected to a lifting hydraulic cylinder.

2. The log splitting improvements as defined in claim 1 wherein said cutting angle has an angle of about 52 degrees and said splitting angle has an angle of about 120 degrees.

3. An improvement in a log-splitting machine of the type having an elongated frame, a log-splitting station defined by a wedge mounted to the frame, a log-splitting cylinder mounted to the frame and having a reciprocating piston adapted to push a log against the wedge, a log lifter for feeding logs to the splitting station of the type having a frame means extending laterally from and pivotally connected at a first end to the log-splitting frame for rotation about an axis between a first ground-contacting position and a second elevated position, the improvement comprising:

a wedge having at least two pairs of working faces defining a cutting angle and a splitting angle and wherein the cutting angle has an angle from about 45 to 60 degrees and said splitting edge has an angle of from about 100 to 140 degrees; and wherein said log lifter is a two-part pivotally attached log-lifting table operably connected to a lifting hydraulic cylinder wherein said two-part log-lifting table is further provided with multiple points of attachment to said second hydraulic cylinder to define a lifting position and a transport position for said log-lifting table.

4. The log splitting improvements as defined in claim 3 further comprising lifting means for raising said frame to a working position and lowering said frame to a towing position.

* * * * *